United States Patent [19]

Street

[11] Patent Number: 4,625,962

[45] Date of Patent: Dec. 2, 1986

[54] UPPER BODY EXERCISE APPARATUS

[75] Inventor: Glenn M. Street, State College, Pa.

[73] Assignee: The Cleveland Clinic Foundation, Cleveland, Ohio

[21] Appl. No.: 663,169

[22] Filed: Oct. 22, 1984

[51] Int. Cl.[4] ..... A63B 21/22

[52] U.S. Cl. ..... 272/132; 272/69; 272/97; 272/DIG. 6; 272/72

[58] Field of Search ..... 272/132, 70, 72, 73, 272/69, 79, 136, DIG. 6, DIG. 5, 97; 128/25 R

[56] References Cited

U.S. PATENT DOCUMENTS

| | | | |
|---|---|---|---|
| 2,117,957 | 5/1938 | Heller | 272/69 |
| 2,641,250 | 6/1953 | Brockman | 128/25 R |
| 2,964,973 | 12/1960 | Bergfors | 128/25 R |
| 3,511,097 | 5/1970 | Corwin | 272/73 |
| 3,608,900 | 9/1971 | Welch . | |
| 3,752,474 | 8/1973 | Macabet et al. . | |
| 3,767,195 | 10/1973 | Dimick | 272/DIG. 6 X |
| 4,023,795 | 5/1977 | Pauls . | |
| 4,047,715 | 9/1977 | Gjessing | 272/132 |
| 4,077,626 | 3/1978 | Newman . | |
| 4,109,907 | 8/1978 | Zito . | |
| 4,323,237 | 4/1982 | Jungerwirth | 272/DIG. 6 |
| 4,402,502 | 9/1983 | Peters | 128/25 R |
| 4,537,396 | 8/1985 | Hooper | 272/73 X |

FOREIGN PATENT DOCUMENTS

| | | | |
|---|---|---|---|
| 923517 | 3/1973 | Canada | 272/132 |
| 1185846 | 8/1959 | France | 272/73 |
| 2047548 | 12/1980 | United Kingdom | 272/DIG. 6 |

OTHER PUBLICATIONS

Popular Science, Oct. 1981, p. 80.

*Primary Examiner*—Richard J. Apley
*Assistant Examiner*—Robert W. Bahr
*Attorney, Agent, or Firm*—Fay, Sharpe, Fagan, Minnich & McKee

[57] ABSTRACT

A lower support frame (A) mounts a lower body support structure (B) and an upper body exercise structure (C) thereon. The upper body exercise structure includes an upper frame (30) which is selectively and adjustably mounted on the lower support frame. A flywheel (40) is rotatably mounted in the upper frame. A belt (52) and selectable number of weights (62) drag along the flywheel for selectively adjusting the effort required to maintain rotation of the flywheel. Flexible cables (70, 72) are each wrapped around a pulley (84). A one-way clutch (86) selectively connects the pulley with the flywheel for providing rotational driving force thereto as the cable is pulled. A rewind spring (92) rewinds the cable back onto the pulley. The relative positions of the lower body support structure (B) and the upper body exercise structure (C) are selectively adjustable such that the exercise apparatus is usable in training for walking or running (FIG. 1), ski poleing (FIG. 4), canoeing or kayaking (FIG. 5), rowing (FIG. 6), and other sports.

15 Claims, 6 Drawing Figures

UPPER BODY EXERCISE APPARATUS

BACKGROUND OF THE INVENTION

The present invention relates to the art of physical fitness apparatus. It finds particular application in conjunction with upper body exercise apparatus to train for cross-country skiing, canoeing, rowing, and the like. Although the invention is described in conjunction with upper body training for these sports, it is to be appreciated that the invention is also applicable to other conditioning, exercise, and body-building applications.

Heretofore, various exercise apparatus have been devised for both the upper and lower body. In one type of apparatus, the athlete pulls on handles which are attached to ropes or cables. In some of the prior art apparatus, the ropes or cables are connected to weights. In others, the ropes or cables are interconnected such that the one arm is pulling against the other. In another type of apparatus, the athlete works to maintain rotation of a flywheel. A friction brake controls the amount of effort required to maintain flywheel rotation.

Although these prior art exercise systems have found acceptance, each has its drawbacks. One drawback shared by many prior art exercise systems is that only the upper or lower body is exercised. Even those systems which exercise both the upper and lower body frequently fail to balance the upper and lower body exercise in a manner appropriate to the sport for which the athlete is training. This lack of balance detracts from the athlete's overall training program and tends to inhibit the development of muscle tone and coordination.

The present invention contemplates a new and improved exercise apparatus which is ideally suited to provide upper body exercise in proper balance and coordination with lower body exercise for a variety of sports.

SUMMARY OF THE INVENTION

In accordance with the present invention, an exercise apparatus is provided. A flywheel is rotatably mounted on a frame and an adjustable drag means is provided for selectively adjusting the effort required to maintain rotation of the flywheel. Flexible cables extend from handles to a drive means for selectively rotating the flywheel. In this manner, pulling of the handles with effort as determined by the adjustable drag means causes the drive means to rotate the flywheel.

In accordance with another aspect of the present invention, the frame is selectively mounted on a lower support frame which includes means for simultaneously exercising the athlete's lower body portion.

In accordance with another more limited aspect of the invention, the drive means includes a one-way clutch which is interconnected with each cable. A rewind spring is connected with the one-way clutch for rewinding the cables between each pull. In this manner, the athlete pulls the cable with an amount of effort as determined by the adjustable drag means and selectively limits the rate of return of the cable with an amount of force as determined by the rewind spring.

One advantage of the present invention is that it enables the athlete to exercise upper and lower body muscles simultaneously in a balanced relationship.

Another advantage of the present invention is that it facilitates the development of overall body tone and coordination.

Yet another advantage of the present invention is that it is readily adaptable for use in conjunction with a variety of upper body training programs.

Still further advantages of the present invention will become apparent upon reading and understanding the following detailed description of the preferred embodiments.

BRIEF DESCRIPTION OF THE DRAWINGS

The invention may take form in various parts and arrangements of parts. The drawings are only for purposes of illustrating a preferred embodiment and are not to be construed as limiting the invention.

DETAILED DESCRIPTION OF THE PREFERRED EMBODIMENTS

Figure 1:
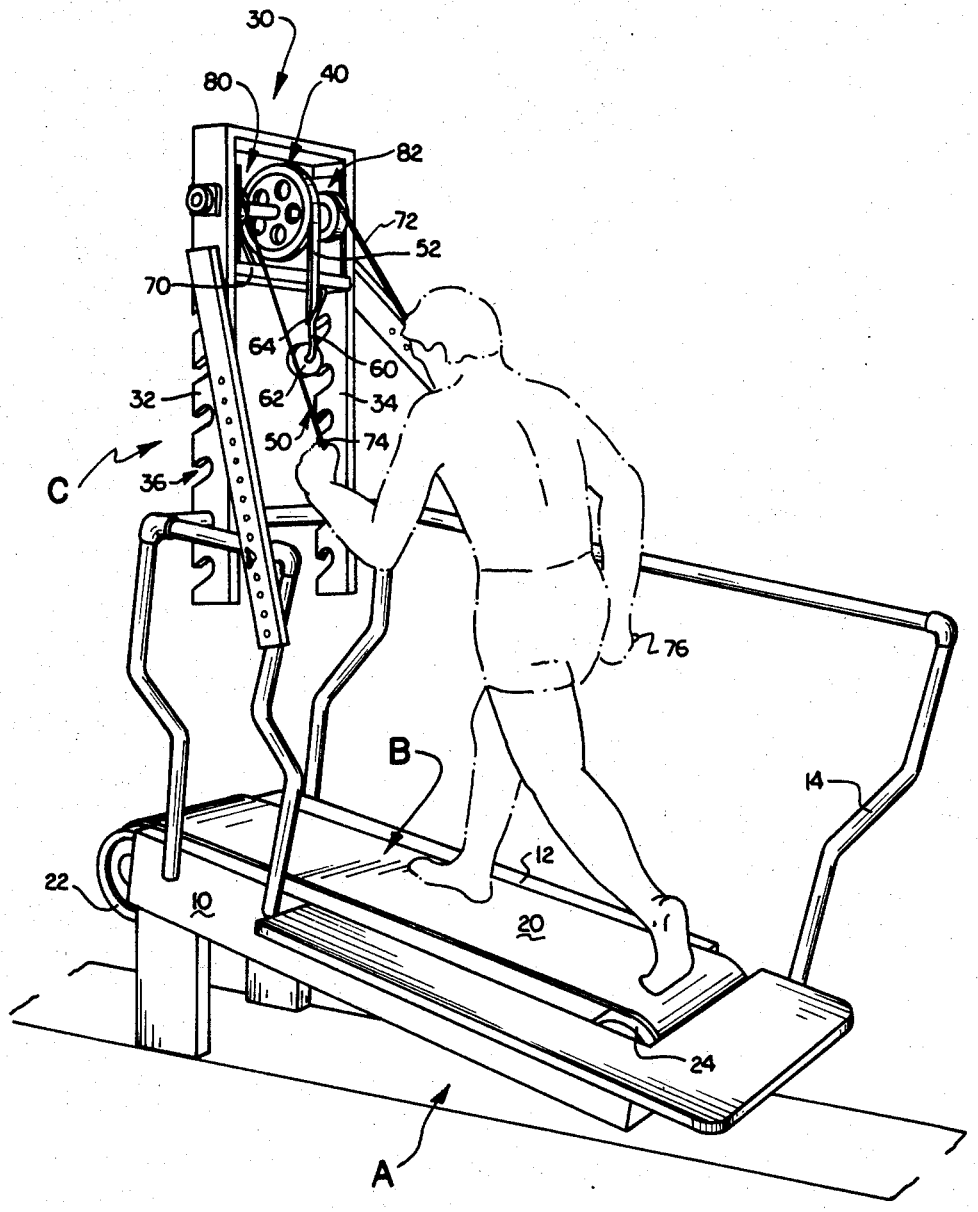
FIG. 1 is a perspective view of the present invention in combination with a treadmill for coordinated exercising of the upper and lower body in a manner which is ideally suited for training for running or jogging.

With reference to FIG. 1, the exercise apparatus includes a lower support frame portion A which rests on the floor or other supporting surface. A lower body support structure B is mounted on the lower support frame to support the athlete thereon, particularly, the lower body portion of the athlete. An upper body exercise structure C is selectively connected with the lower frame to be supported thereby in an appropriate position for the athlete to exercise upper body muscles.

The lower support frame includes side rails or structures 10, 12, from which an upstanding frame portion or hand rail 14 extends. The lower body support structure B includes a treadmill mounted on the lower support frame. The treadmill includes an endless belt 20 which is rotatably mounted on a pair of rollers 22, 24. An adjustable friction brake, not shown, selectively adjusts the amount of resistance to movement of the belt 20.

The upper body exercise structure C includes a frame 30 having vertically mounted side pieces 32 and 34. The side frame members 32, 34 include adjustable mounting means, such as angled U-shaped recesses 36, for selectively and adjustably mounting the upper body exercise structure C on the upstanding portion 14 of the lower support frame A.

Figure 2:
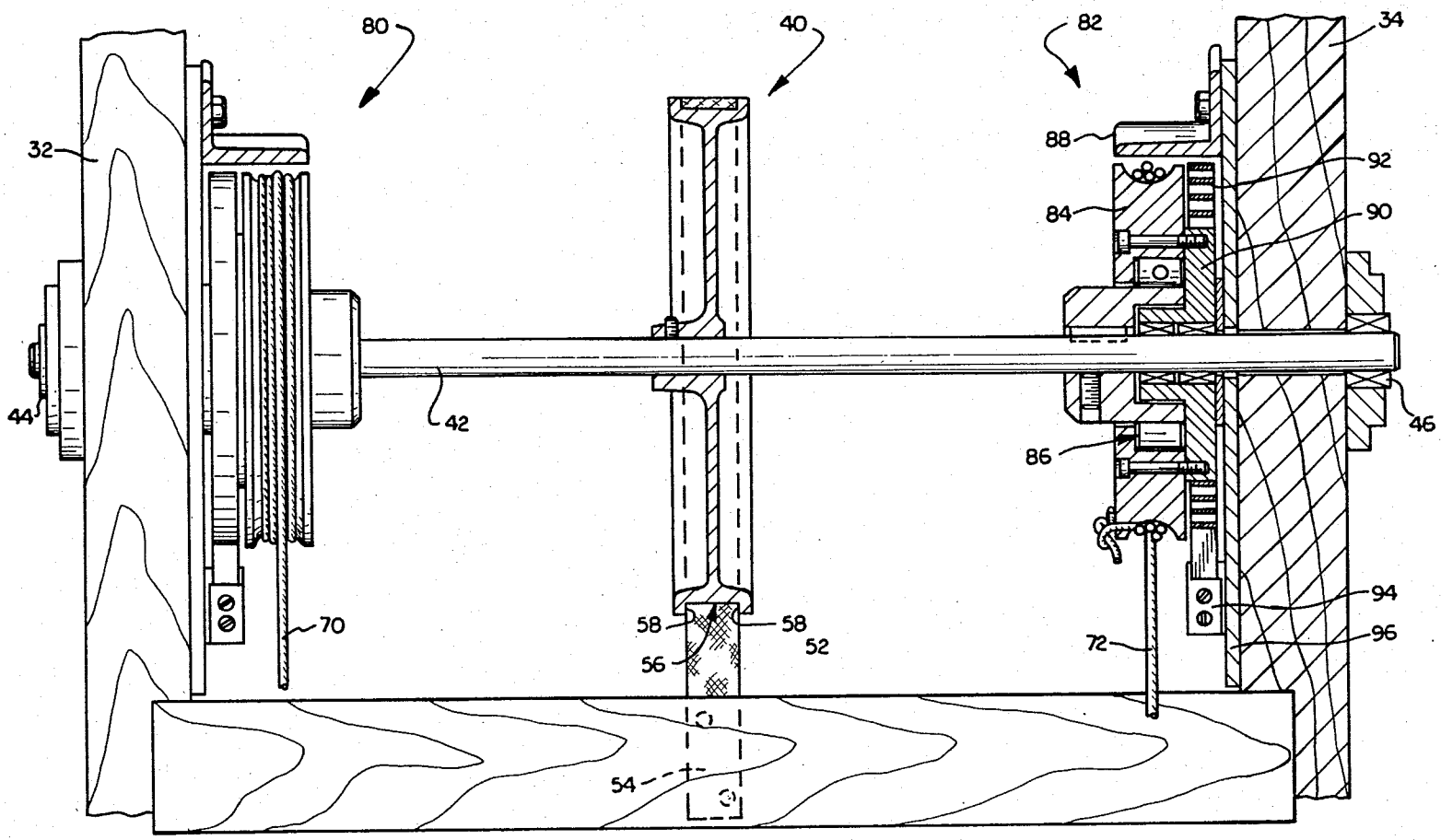
FIG. 2 is a front sectional view of the flywheel and one-way drive assembly of FIG. 1.

With continuing reference to FIG. 1 and further reference to FIG. 2, a flywheel 40 is rotatably mounted in the upper frame 30. More particularly to the preferred embodiment, the flywheel is fixedly mounted on a rotating shaft 42 which is connected with bearings 44, 46 mounted on the frame side members 32, 34, respectively.

An adjustable drag means 50 selectively adjusts the effort required to maintain rotation of the flywheel 40. The adjustable drag means includes a belt 52 which is mounted at one end 54 to the upper frame 30. The belt extends through a channel in the flywheel 40 defined by a bottom surface 56 and side walls 58. A hook or similar mounting means 60 enables weights 62 of various sizes to be connected on an opposite end 64 of the belt. By selectively adjusting the amount of weight hung on the second end of the belt, the amount of frictional drag applied by the belt 52 to the flywheel 40 is adjusted. In this manner, the amount of effort which the athlete must expend to maintain the flywheel rotating is selectively adjustable.

A pair of ropes or cables 70, 72 extend between handles 74, 76, respectively, at one end. The other ends of the cables are connected with drive means 80, 82 for selectively converting the force exerted by the athlete in pulling on the cables into rotation driving force for the flywheel 40.

With particular reference to FIG. 2, because both drive means are of analogous construction, drive means 82 will be described in detail and it is to be appreciated that the description applies by analogy to drive means 80. In the preferred embodiment, the drive means is a one-way friction clutch. However, ratchet and other drives which convert the back and forth movement of the cables to rotation of the shaft are contemplated. A pulley 84 having a rope or cable receiving recess around the outer periphery thereof is connected with a one-way frictional engagement assembly 86. The one-way assembly interconnects the pulley and the shaft 42 as the pulley rotates in a first direction relative to the shaft and allows sliding motion therebetween as the pulley rotates in the opposite direction. A cable guard 88 is mounted on the frame and extends closely adjacent the outer peripheral recess in the pulley 84 to prevent the cable or rope from jumping from the peripheral pulley recess.

A spring holder 90 is operatively connected with the pulley 84 for rotational movement therewith. A coil spring 92 spirals radially outward from the spring holder 90. One end of the spring is connected with the spring holder 90 and the other end is mounted in a spring holding block 94 which is interconnected with the upper frame 30. A metal protection plate 96 is mounted between the coil spring 92 and the frame assembly 30 for preventing the spring from engaging and damaging the frame side portions.

In operation, each time the athlete pulls one of the cables, the corresponding pulley rotates in the first direction which causes the one-way clutch assembly to engage the shaft 42 for rotation therewith. The athlete continues pulling the cable with sufficient effort to overcome the resistance provided by the coil spring, the resistance provided by the frictional drag means 50, and the inertia of the flywheel 40. Thereafter, the athlete controlledly allows the coil spring to rotate the pulley in the opposite direction such that the cable is retracted into the peripheral groove therearound. By cyclically pulling and retracting the cables, the flywheel is caused to maintain a generally constant angular velocity or speed.

Figure 3:
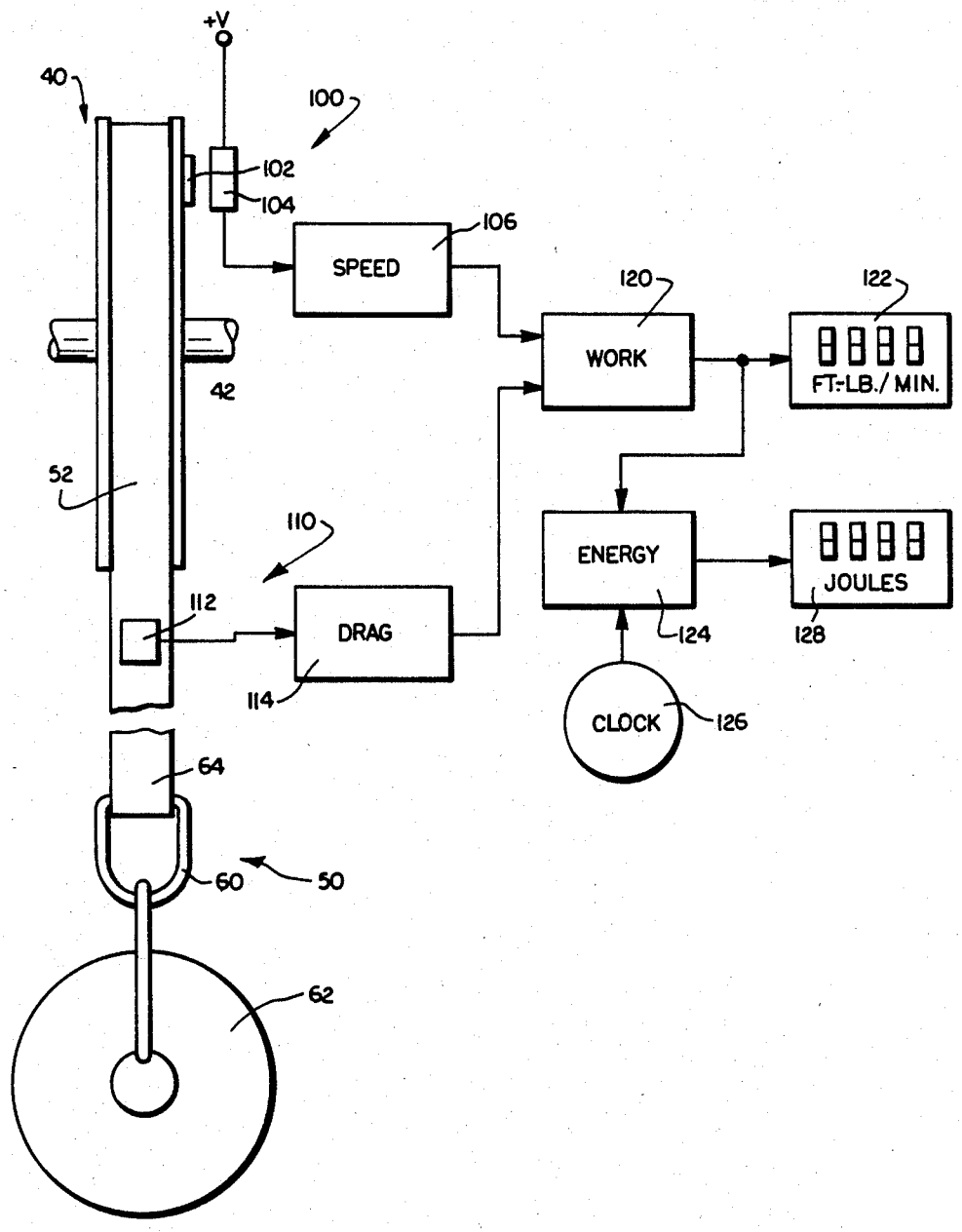
FIG. 3 is a schematic diagram of a system for monitoring exercise rate and total energy expended.

With reference to FIG. 3, an electronic display provides the athlete with a ready reference of the rate at which he is exercising and the total amount of effort that he has expended since the beginning of the exercise session. The circuit includes a tachometer means 100 for determining the angular velocity or speed at which the flywheel is rotating. In one embodiment, the speed determining means includes a magnet 102 mounted on the flywheel and a reed switch 104 which closes each time the magnet passes. A speed circuit 106 converts the rate at which pulses are received from the reed switch into a signal which varies in proportion to the speed or angular velocity of the flywheel. A frictional drag means 110 determines the resistance to rotation applied by the drag means 50. A strain gauge 112 is mounted on the belt 52 to provide an electronic reading indicative of the frictional drag. The drag is proportional to the amount of weight hung on the belt and various system constants, such as the coefficient of friction between the flywheel and the belt. Optionally, other structures for determining the drag or the amount of weight hung on the hook 60 may be used. For example, a keypad may be provided so that the athlete may enter the amount of weight. A drag circuit 114 derives an indication of the drag or resistance which must be overcome to maintain rotation of the flywheel.

A work circuit 120 determines the amount of work or effort which is instantaneously being expended by the athlete to rotate the flywheel at the determined speed while overcoming the determined drag. A work display 122 provides and LED or other man-readable display of the amount of work which the athlete is currently performing. The work may be displayed in various units such as foot-pounds per minute.

An integrating circuit 124 in coordination with a clock 126 integrates the instantaneous amount of work to determine the total amount of energy expended since the beginning of the exercise period. An energy display means 128 provides a visual display of the total energy expended. The total energy expended may be expressed in any suitable unit, such as foot-pounds, calories, or joules. Optionally, a recorder may make a record at regular intervals of the work being expended and the total energy expended since the beginning of the session.

Figure 4:
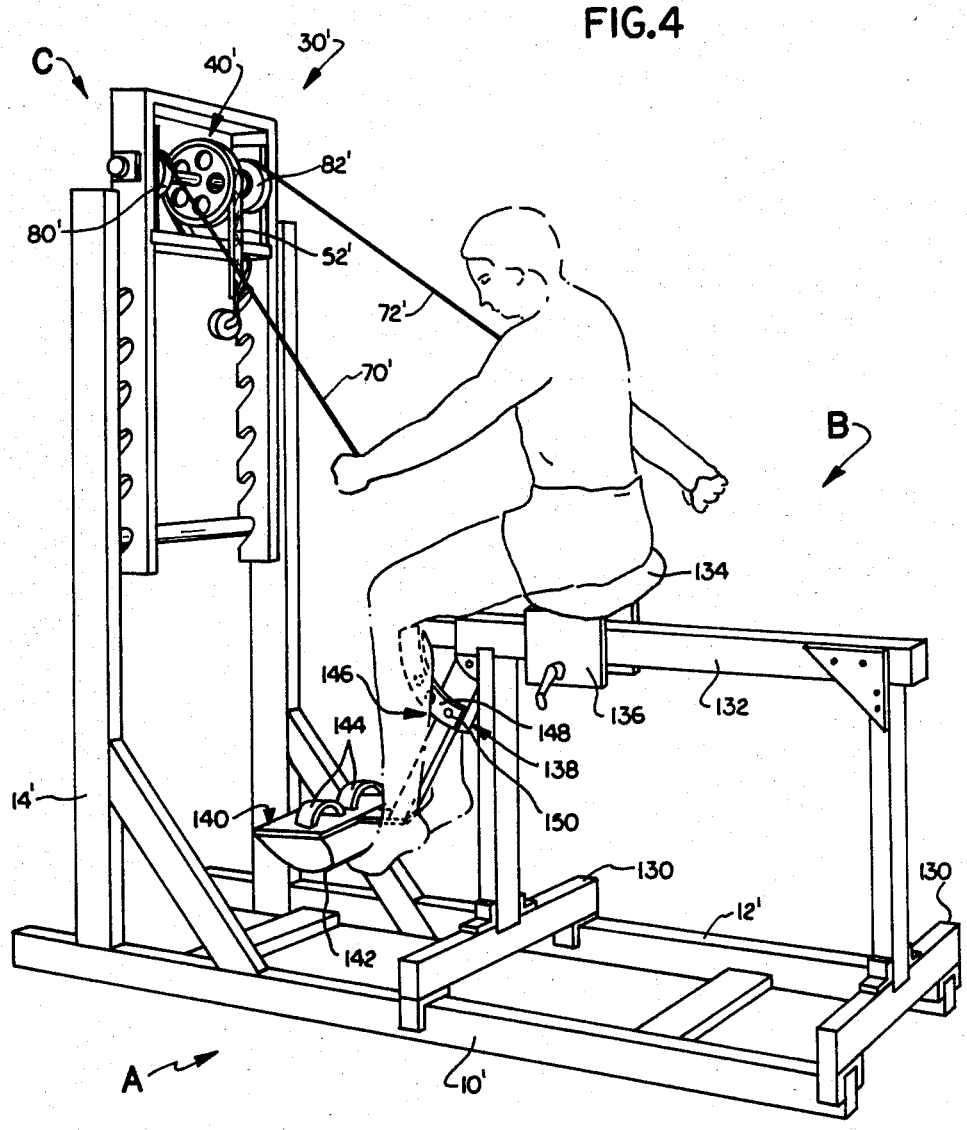
FIG. 4 illustrates an exercise apparatus in accordance with the present invention which is ideally arranged for developing the muscles used in ski poleing.

In the alternate embodiment of FIG. 4, the exercise apparatus is configured to train for cross-country skiing and other activities that require poleing and the like. In the embodiment of FIG. 4, like elements with the embodiment of FIG. 1 are denoted by the same reference numerals but followed by a prime (′). The lower support frame A includes horizontal supporting rails 10′ and 12′ which are interconnected with an upstanding frame portion 14′.

The lower body support structure B includes frame portions 130 which are selectively mounted with the lower support frame side rails 10′ and 12′. A longitudinally extendir.g rail 132 selectively receives an athlete supporting seat 134 thereon. A seat position adjusting means 136 enables the seat to be selectively positioned along the rail 132 and locked in the selected position. A telescopically adjustable member 138 extends from the longitudinal rail 132 to a foot supporting structure 140. The foot supporting structure includes a rounded portion or surface 142 under which the athlete may lock his feet and ankles. On an opposite surface, a pair of foot receiving loops or stirrups 144 are provided. An angular adjustment mechanism 146 enables the angle of the telescopic member 138 to be selectively adjusted. In the preferred embodiment, the angular adjustment mechanism includes a pair of arcuate members 148 disposed on opposite sides of the telescopic member having an array of aligned apertures extending therethrough. A pin 150 selectively extends through the aligned apertures and a corresponding aperture in the telescopic member 138 for selectively adjusting the angular position thereof. In this manner, the position and orientation of the foot supporting structure is selectively adjustable.

The upper body exercise structure C includes a frame portion 30' which is selectively mounted to the lower frame upstanding portion 14' at any of a plurality of heights. A flywheel 40', over which a drag belt 52' is positioned, is selectively rotated as the athlete alternately or simultaneously pulls cables 70', 72', to cause drive means 80', 82' to rotate the flywheel.

As arranged in FIG. 4, the drive means 80' and 82' are positioned above the athlete such that he is pushing downward and rearward as the cables are pulled. The seat 134 and foot support 140 are disposed such that the athlete's knees are bent and his body is inhibited against being lifted upward. This enables the athlete to develop and tone the muscles used for pushing on ski poles during cross-country skiing.

Figure 5:
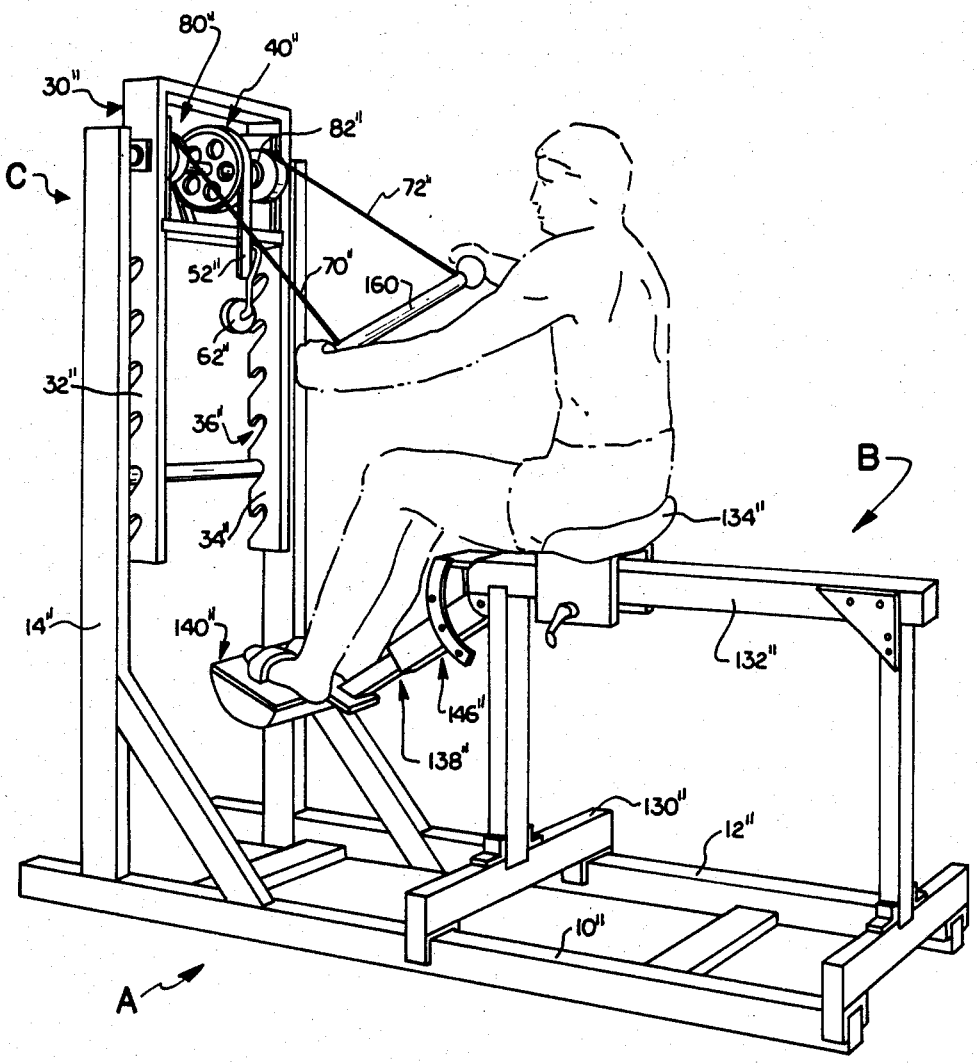
FIG. 5 illustrates an arrangement of the present invention which is ideally suited to training for canoeing or kayaking; and, FIG. 6 illustrates another embodiment of the present invention which is ideally suited to training for rowing.

In the embodiment of FIG. 5, like elements with the embodiment of FIG. 4 are denoted by the same reference numerals but followed by a double prime (''). To enable the athlete to develop muscles used for canoeing or kayaking, cables 70'' and 72'' extend from opposite ends of a handle portion 160. As illustrated, the handle 160 has enlarged portions at either end analogous to the upper end of a canoe paddle such that the athlete may paddle to either side to develop both arms. Optionally, the handle 160 may be a regular canoe paddle. As yet another option, the handle 160 may be a double-sided paddle as used in kayaking. The stroking or paddling movement of the handle 160 pulls the cables 70'' and 72'' to cause one-way friction drive means 80'' and 82'' to maintain rotation of a flywheel 40''. The upper frame assembly 30'' is mounted lower relative to the lower frame upstanding portion 14'' such that the component of motion exerted by the athlete is more nearly rearward and less downward than in the embodiment of FIG. 4. That is, the height of the one-way friction drive means is adjusted such that the effort exerted in pulling the cables is in a direction appropriate to the sport. A seat 134'' of the lower body supporting structure B and the position of a foot supporting means 140'' are selected to be in a position roughly corresponding to the position in canoeing or kayaking. It should be noted, that the athlete need not be at the same angular orientation relative to horizontal as in a canoe or kayak. Rather, the athlete may be rotated from the normal canoeing or kayaking position and the height of the upper frame portion 30'' may be adjusted correspondingly such that the paddling motion is in the proper direction relative to the athlete.

Figure 6:
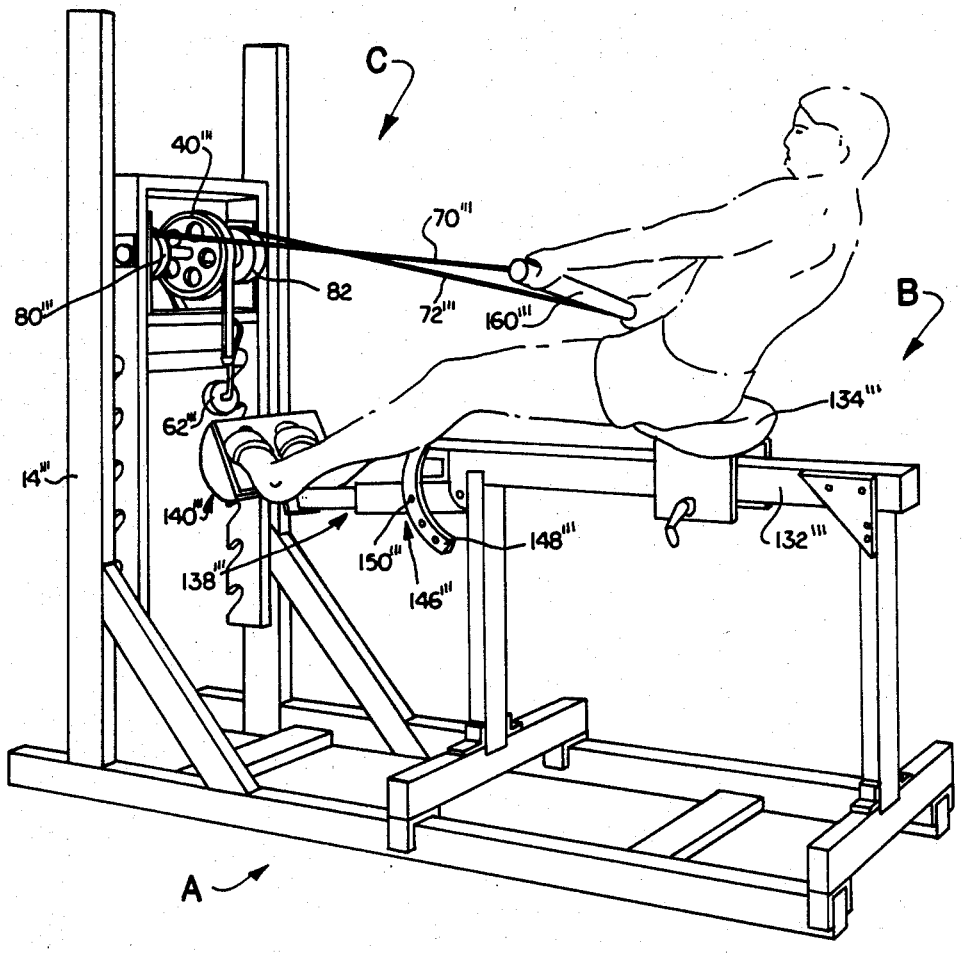

In FIG. 6, like elements with the embodiments of FIGS. 4 and 5 are denoted with the same reference numerals but followed by a triple prime (''').  A foot support 140''' is positioned generally straight in front of the athlete by an angular adjustment means 146'''. A seat 134''' is positioned rearward on a rail 132''' such that the athlete's legs are relatively straight. Optionally, slide means may be provided for enabling the seat 134''' to slide relative to the rail 132'''. The upper body exercise structure C is mounted relatively low on the lower support frame A such that as the athlete pulls on a handle 160''' cables 70''' and 72''' are pulled generally horizontally. The cables are connected with drive means 80''' and 82''' for maintaining a flywheel 40''' rotating at a substantially constant speed. The athlete must put sufficient energy into the flywheel to compensate for the energy lost by the drag applied by drag strap 52''' and weight 62'''.

The invention has been described with reference to the preferred embodiments. Obviously, modifications and alterations will occur to others upon reading and understanding the preceding specification. It is intended that the invention be construed as including all such alterations and modifications insofar as they come within the scope of the appended claims or the equivalents thereof.

Having thus described preferred embodiments of the invention, the invention is now claimed to be:

1. An exercise apparatus comprising:

(a) a lower support frame including an upstanding frame portion extending upward to at least about the height of an athlete's waist;

(b) a lower body support structure operatively connected with the lower support frame, the lower body support structure including:

(i) a lower support assembly supported on the lower support frame;

(ii) a longitudinally extending rail mounted horizontally on the lower support assembly and extending parallel to a floor on which the exercise apparatus is disposed;

(iii) an athlete supporting seat mounted to the support rail to be selectively and fixedly positioned therealong;

(iv) a telescopic member pivotally connected at one end with the longitudinally extending rail;

(v) a foot supporting structure connected with an other end of the telescopic member such that telescopic member adjusts a distance between the foot supporting structure and the longitudinally extending rail;

(vi) an angular adjustment mechanism for selectively fixing a relative angular relationship between the telescopic member and the longitudinally extending rail;

(c) an upper frame;

(d) a flywheel rotatably mounted adjacent a top of the upper frame;

(e) an adjustable drag means for selectively adjusting the effort required to maintain rotation of the flywheel;

(f) a drive means for selectively rotating the flywheel, the drive means being mounted contiguous to the flywheel;

(g) an adjustable mounting means for selectively mounting the upper frame to the lower support frame such that the flywheel and drive means are adjustably mounted above the athlete's head;

(h) flexible cables extending downward from the drive means to at least one handle such that pulling the cables downward and rearward with effort as determined by the adjustable drag means causes the drive means to rotate the flywheel.

2. The exercise structure as set forth in claim 1 wherein the lower body support structure includes exercise means for exercising the lower body in conjunction with exercise of the upper body.

3. The exercise apparatus as set forth in claim 1 wherein the drive means includes a first pulley about which a first of the flexible cables is wrapped and a second pulley about which a second of the flexible cables is wrapped, a first one-way clutch which is connected between the first pulley and the flywheel, and a second one-way clutch which is operatively connected between the second pulley and the flywheel, and wherein the handle is an elongated member connected with the first and second cables such that an athlete can move the elongated member in a manner analogous to rowing, canoeing, or kyacking.

4. The exercise apparatus as set forth in claim 1 further including an angular velocity measuring means for measuring the speed with which the flywheel is currently rotating, a work calculating means for calculating the current amount of work being expended from the measured flywheel speed and an indication of the amount of drag applied by the adjustable drag means.

5. The exercise apparatus as set forth in claim 4 further including an energy calculating means for calculating the total amount of energy expended since the beginning of an exercise session from the calculated current amounts of work and a display means for displaying an indication of at least one of the calculated amount of work and energy.

6. An exercise apparatus comprising:

(a) a lower support frame including:
  (i) a pair of parallel lower support rails;
  (ii) an upstanding frame portion extending upward from the lower support rails;

(b) a lower body support structure including:
  (i) lower supports movably supported on the lower support rails to be selectively and fixedly positional therealong;
  (ii) a longitudinally extending rail mounted above the lower supports and extending parallel to the lower support rails;
  (iii) an athlete supporting seat mounted to the support rail to be selectively fixedly positioned therealong;
  (iv) a telescopic member pivotally connected at one end with the longitudinally extending rail;
  (v) a foot supporting structure connected with an other end of the telescopic member such that telescopic adjustment of the telescopic member adjusts a distance between the foot supporting structure and the longitudinally extending rail;
  (vi) an angular adjustment mechanism for selectively fixing a relative angular relationship between the telescopic member and the longitudinally extending rail;

(c) an upper body exercise structure including:
  (i) an upper frame selectively mounted on the lower support frame upstanding portion;
  (ii) a flywheel rotatably mounted on the upper frame,
  (iii) an adjustable drag means for selectively adjusting the effort required to maintain rotation of the flywheel;
  (iv) a drive means for selectively rotating the flywheel;
  (v) flexible cables extending from the drive means to at least one handle such that pulling the cables with effort as determined by the adjustable drag means causes the drive means to rotate the flywheel.

7. The exercise apparatus as set forth in claim 6 wherein the lower support frame includes an upper extending portion and wherein the upper frame includes a plurality of generally U-shaped recesses for selectively engaging the lower frame upper extending portion in any one of a plurality of height relationships, whereby the height of the upper body exercise structure and the relative angle at which the cables are pulled is selectively adjustable.

8. The exercise apparatus as set forth in claim 6 wherein the foot support structure includes a rounded surface for selectively receiving the athlete's feet thereunder and foot receiving loops on an opposite surface thereof.

9. The exercise apparatus as set forth in claim 6 wherein the angular adjustment mechanism includes at least one arcuate member which extends from the longitudinally extending rail, the arcuate member having a plurality of apertures therein and the telescopic member having at least one aperture which is selectively positioned in alignment with one of the arcuate member apertures as the telescopic member is pivoted, and a pin means for selective insertion through aligned arcuate member and telescopic member apertures.

10. The exercise apparatus as set forth in claim 6 further including:

an angular velocity measuring means for measuring the speed with which the flywheel is rotating and generating a speed signal indicative of the measured speed;

a drag signal means for generating a drag signal indicative of the amount of drag applied by the adjustable drag means;

a work calculating means for calculating the current amount of work being expended from the speed signal and the drag signal; and, a display means for displaying the current calculated amount of work being expended.

11. The exercise apparatus as set forth in claim 10 further including a rewind spring operatively connected with the pulley for rewinding the cable thereonto.

12. The exercise apparatus as set forth in claim 11 wherein the rewind spring is a spiral coil spring having one end operatively connected with the pulley and the other end operatively connected with the frame.

13. The exercise apparatus as set forth in claim 12 further including a protection plate disposed between the frame and the spring for preventing injurious interaction therebetween.

14. The exercise apparatus as set forth in claim 10 wherein the pulley has a peripheral groove for receiving the cable therein and further including cable restraining means extending from the frame closely adjacent the periphery of the pulley to prevent the cable from jumping from the peripheral groove.

15. The exercise apparatus as set forth in claim 10 wherein the adjustable drag means includes a belt extending along a peripheral portion of the flywheel and at least one weight selectively hung thereon such that the amount of drag is selectively adjusted by adjusting the amount of weight hung on the belt.

* * * * *